United States Patent [19]

Romanchik et al.

[11] Patent Number: 4,569,596

[45] Date of Patent: Feb. 11, 1986

[54] PNEUMATIC CONVEYING AND MATERIAL BLENDING APPARATUS AND METHOD

[75] Inventors: Robert E. Romanchik, Allentown; James C. Short, Whitehall, both of Pa.

[73] Assignee: Fuller Company, Bethlehem, Pa.

[21] Appl. No.: 444,636

[22] Filed: Nov. 26, 1985

[51] Int. Cl.[4] ..... B01F 13/02

[52] U.S. Cl. ..... 366/107

[58] Field of Search ..... 366/101, 106, 107, 184, 366/192, 267, 341

[56] References Cited

U.S. PATENT DOCUMENTS

| | | | |
|---|---|---|---|
| 376,626 | 1/1888 | Belton | 366/266 |
| 2,735,803 | 2/1956 | Leffer . | |
| 2,844,361 | 7/1958 | Dilcher et al. | 259/1 |
| 3,148,864 | 9/1964 | McClellan et al. | 259/4 |
| 3,148,865 | 9/1964 | McClellan et al. | 259/4 |
| 3,159,383 | 12/1964 | Munster | 366/107 |
| 3,276,753 | 10/1966 | Solt et al. | 259/95 |
| 3,334,868 | 9/1967 | Lage . | |
| 3,351,326 | 11/1967 | Alberts et al. | 259/95 |
| 3,386,182 | 6/1968 | Lippert | 366/107 |
| 3,386,707 | 6/1968 | Brown | 366/266 |
| 3,642,178 | 2/1972 | Balzau | 222/195 |
| 3,647,188 | 3/1972 | Solt | 259/4 |
| 3,648,985 | 3/1972 | Matweecha | 259/4 |
| 3,727,556 | 4/1973 | Adams | 366/266 |
| 3,729,175 | 4/1973 | Matweecha | 259/4 |
| 3,807,705 | 4/1974 | Mumkey | 366/101 |
| 3,881,702 | 5/1975 | McIver | 366/107 |
| 3,911,594 | 10/1975 | McIntire et al. | 34/102 |
| 4,096,640 | 6/1978 | Krambrock et al. | 34/10 |
| 4,128,343 | 12/1978 | Moked et al. | 366/101 |
| 4,168,913 | 9/1979 | Kono | 366/101 |
| 4,194,845 | 3/1980 | Krambrock et al. | 366/101 |

FOREIGN PATENT DOCUMENTS

| | | | |
|---|---|---|---|
| 749832 | 1/1967 | Canada | 366/107 |

*Primary Examiner*—Philip R. Coe
*Assistant Examiner*—Frankie L. Stinson
*Attorney, Agent, or Firm*—Frank H. Thomson

[57] ABSTRACT

A pneumatic conveying and material blending system and method which includes a bin having an open-ended vertical column mounted therein with the bottom of the column being spaced from the bottom of the bin. The material inlet is located in the bottom of the bin and a pneumatic conveying system supplies material to be blended from a source of the material inlet and conveys the material upwardly through the column so that material is discharged from the top of the column in the manner of a geyser whereby it is spread over the top surface of material already in the bin. The material already in the bin is drawn into the bottom of the column so that material already in the bin is blended with material being conveyed to the bin. A deflector is positioned over the top of the column to aid in spreading the incoming material. Booster gas can be supplied through a section of the bin adjacent the bottom of the column. This gas may be supplied by using a vacuum applied to the bin through a vent in the bin or by a blower supplying air or gas directly to a manifold surrounding the gas permeable surface. The outlet of the bin is coextensive with the inlet of the bin so that material is drawn out of the central opening in the bottomm of the bin. Internal recirculation is also contemplated by this invention.

5 Claims, 5 Drawing Figures

PNEUMATIC CONVEYING AND MATERIAL BLENDING APPARATUS AND METHOD

BACKGROUND OF THE INVENTION

The present invention relates to pneumatic conveying systems and in particular to a material blending system in combination with a pneumatic conveying system. The invention while not intended to be limited thereby is particularly applicable for use in achieving a homogeneous quantity of material such as pellets, powders, and granular material.

Prior to the present invention, material blenders were known including blenders for plastic pellets. Typical prior art blenders for solid particulate material include gravity type blenders wherein a plurality of withdraw tubes are mounted within a bin and material is withdrawn from the bin through the tubes which have openings at various levels within the bin. The withdrawn material is supplied to a conveying line where it is usually recirculated back into the top of the bin for withdraw a subsequent time. After a given number of recirculation cycles, the material is sent to a use point. Typical of such blenders is that shown in U.S. Pat. No. 3,351,326.

Another type of blender includes a bin or silo with an aerated bottom wherein material to be blended is supplied to the bin through an inlet in the top, a gas permeable silo bottom has air supplied therethrough to aerate material within the bin or silo. One section of the bin bottom is supplied with higher pressure air to fluidize material above that section so that material above that section spills onto other portions of the silo. Material in the aerated sections is drawn into the fluidized section. The section which is fluidized is changed in cycles. A typical such apparatus is disclosed in U.S. Pat. No. 2,844,361.

A further type of blender is a column blender such as that shown in U.S. Pat. Nos. 3,648,985 and 3,729,175. In this type of apparatus, a hollow open-ended column is mounted centrally within a bin. The bin is provided with a top material inlet and a gas permeable bottom for aerating or fluidizing material within the bin. Higher pressure air is supplied into the bottom of the column to draw material in the bin into the column for movement up through the column in the manner of an air lift for dispersal onto the top surface of the material in the bin. While such apparatus has an advantage of blending pelletized material, it has a disadvantage that the blending takes a substantial period of time, the means for supplying the material to be blended to the bin is not fully utilized and high energy is required to achieve the blending of material.

A further type of blender for pulverized material is shown in U.S. Pat. Nos. 3,148,864 and 3,148,865 wherein material is pneumatically conveyed into the bottom of a bin and the action of the material entering the bin serves to blend material already in the bin with material being supplied thereto. The apparatus and method disclosed by these two patents is particularly useful for very fine grained material such as talc. The apparatus shown in these two patents has not achieved wide acceptance and requires several feed points for the material into the bottom of the bin.

A blender which combines some of the features of the prior art is shown in U.S. Pat. No. 3,276,753 wherein a device is shown which is capable of being filled with material to be blended from either a top fill point or a bottom fill point which is directly connected to an air lift column mounted in the material bin. With that device it was considered that some blending occurred in the filling of the bin, it was apparently considered necessary to have withdrawal from several points and external recirculation of material to achieve adequate blending.

By the present invention, Applicants have provided a blending apparatus and system which is capable of combining the advantages of several of the prior art blenders and is able to do so at an economical cost. With the present invention a bin already in existence which is presently being used for storage can be converted by an economical means to a blending system which is particularly adapted for use with plastic pellets such as polyethylene pellets. The invention is also suitable for all solid particulate material including but not limited to cement raw meal, powders, sand and the like.

The present invention has several advantages over the prior art blenders in that is utilizes the conveying system energy to not only supply material to the storage bin but also to provide continuous blending of the material from the beginning of the filling cycle to the end of the filling cycle to thereby cut down on production time and save energy. The blender of the present invention saves substantial capital investment by a simple construction of a single blender column because material is supplied to the bottom of the blender and removed from the bottom of the blender. Less piping is required when compared to prior art devices where material is supplied to the top of the blending bin. The blender can eliminate the external piping associated with a tube type gravity blender when required for material recirculation. While internal circulation of materials is contemplated by the present invention, blending internally results in less degredation of product when compared to external recirculation.

With the blender of the present invention, a means is provided for supplying a booster or fluidizing gas to the bottom of the bin to not only improve blending capability but also to serve to dedust or clean the material and remove or vent gas which may be trapped within the bin or vessel. Boost gas can also be used to aid in the transfer of material to other destinations after blending is completed. The boost gas or fluidizing gas also assists in the uniform flow of material, particularly during the withdrawal of material from the bin.

SUMMARY

It is, therefore, the principal object of this invention to provide a process and apparatus for blending for solid particulate material such as pellets, granules, or powders which provides simplified construction and maximum utilization of energy.

It is a further object of this invention to provide a pneumatic conveying and material blending system and method which utilizes the energy used for pneumatic conveying to achieve the blending of the material and utilizes the dust collector fan to both reduce the energy required to blend the material and serve as a pellet cleaning system and degasifying system.

The foregoing and other objects will be carried out by providing in general a pneumatic conveying and material blending system comprising a bin having an inlet for solid particulate material in the bottom thereof; a hollow, open-ended vertical column mounted in said bin, spaced from the bottom of said bin and spaced from and coaxially aligned with the inlet for material; means for supplying a stream of gaseous fluid and entrained fresh solid particulate material to be blended to said inlet and upwardly through said column and means for supplying booster gas to the bottom of said bin to be directed upwardly into said column; said means for supplying a stream of gaseous fluid and said means for supplying booster gas defining means for conveying solid particulate material already in the bin upwardly through the column whereby said fresh solid particulate material and said solid particulate material already in the bin are dispersed on the top surface of material in the bin to thereby blend the material.

The foregoing and other objects will also be carried out by providing a method of conveying and blending solid particulate material comprising the steps of providing a vessel having an inlet in the bottom thereof and a hollow, open-ended vertical column mounted therein aligned with the inlet and spaced from the bottom of the vessel; establishing a flow of gaseous fluid through a conveying line to said inlet of the vessel; introducing solid particulate material to be blended into the flow of gaseous fluid whereby the material is entrained in the gaseous fluid and conveyed by the gaseous fluid to the inlet of the vessel, up through the column and discharged in a geyser-like manner into the vessel; and independently supplying additional gas under pressure to the bottom of said vessel adjacent the column for assisting material already in the vessel to be drawn into and conveyed up to the column where it is intimately mixed with material being conveyed to the vessel to thereby blend the material.

BRIEF DESCRIPTION OF THE DRAWINGS

The invention will be described in connection with the annexed drawings wherein.

DESCRIPTION OF THE PREFERRED EMBODIMENTS

Figure 1:
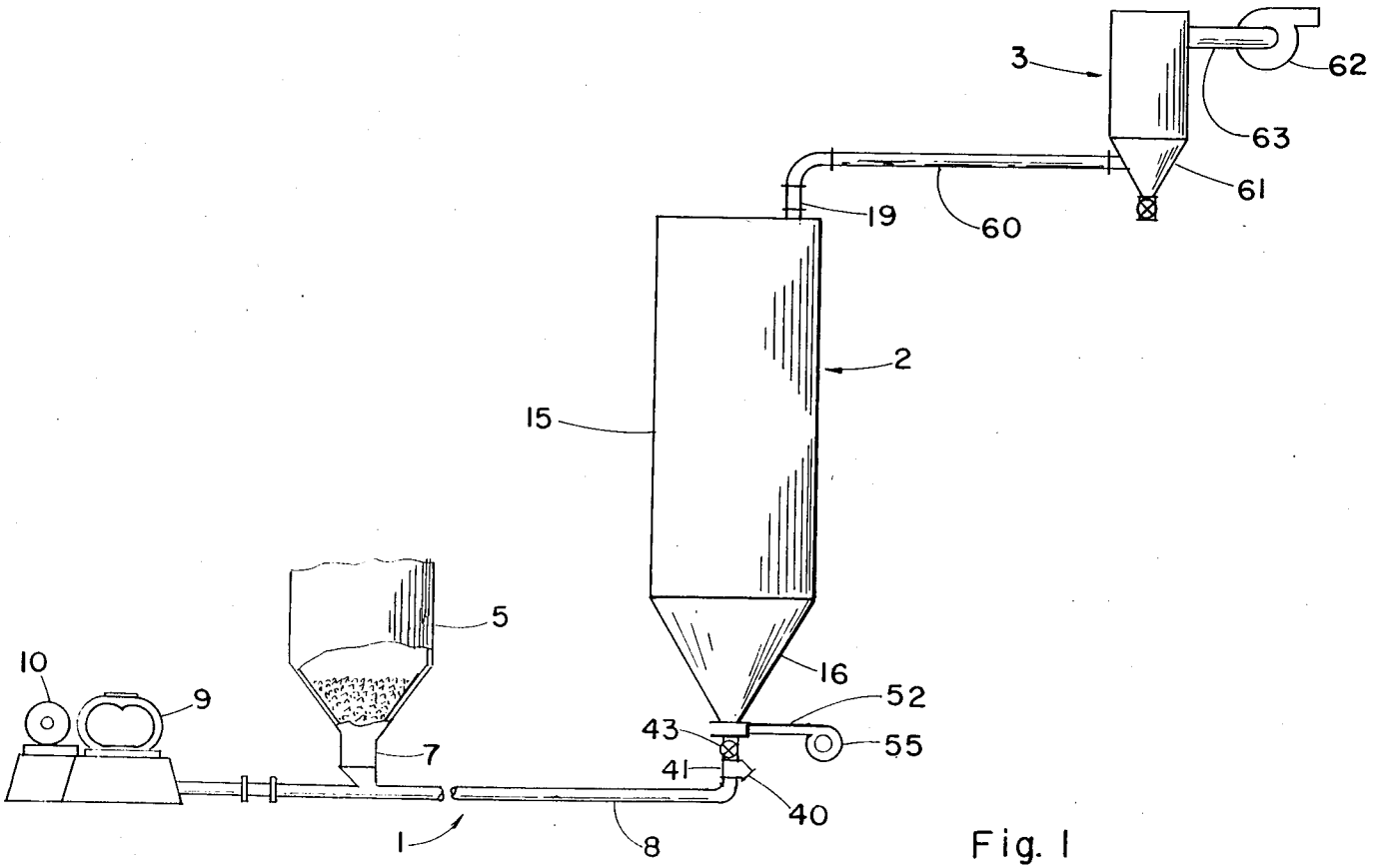
FIG. 1 is a diagrammatic view of a pneumatic conveying and blending system according to the present invention.

Referring initially to FIG. 1, there is shown a pneumatic conveying and blending system according to the present invention. The system includes a pneumatic conveying system generally indicated at 1, a blending vessel generally indicated at 2 and a dust collection system generally indicated at 3.

The pneumatic conveying system includes a bin 5 having an outlet 6 controlled by a valve diagrammatically indicated at 7 for controlling the flow of solid particulate material to be blended into a pneumatic conveying line 8. A blower 9 driven by a motor means 10 supplies gaseous fluid such as air under pressure to the pneumatic conveying line 8 for entraining solid particulate material to be blended and conveying the same through the line 8 to the blending bin 2. Such a pneumatic conveying system is well known to those having ordinary skill in the art. While we have illustrated the use of a blower 9, it will be understood by those skilled in the art that other sources of gas under pressure such as plant air or a central source of inert gas could be used for conveying.

Figure 2:
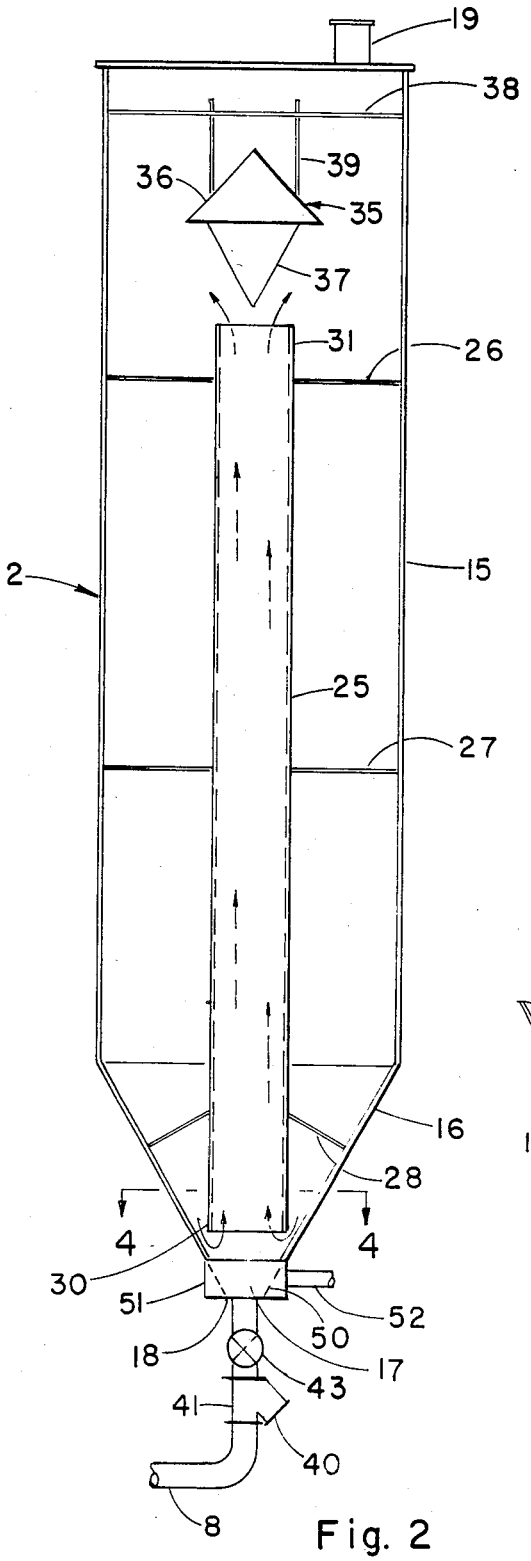
FIG. 2 is a view of the inside of a blending vessel according to the present invention.
Figure 4:
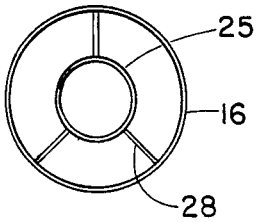
FIG. 4 is a sectional view taken on the line 4—4 of FIG. 2 looking in the direction of the arrows.

Referring to FIG. 2, the blending vessel 2 is shown in greater detail and consists of a bin 15 having a conical bottom 16 and an inlet 17 centrally located in the bottom 18 of the bin. The bin also includes a vent 19 in the top thereof. The bin 15 has an open-ended vertically oriented column 25 mounted therein by means of longitudinally spaced apart mounting brackets 26, 27 and 28. These brackets are circumferentially spaced apart as shown in FIG. 4. The column 25 has a lower end 30 spaced from the bottom 18 of the bin 15 and a top end 31.

Also mounted within the bin 15 is a deflector means 35 shown in the form of a "Chinese hat" at the top thereof as indicated at 36 and a conical portion 37 pointed downwardly towards but spaced from the top 31 of the column 25. The deflector means 35 is mounted by means of brackets 38 and 39. Other suitable arrangements for mounting the deflector are contemplated by the present invention and will be apparent to those having ordinary skill in the art.

The bin 15 also includes an outlet which is integral with the inlet 17. The outlet is actually formed by a material conveying conduit 40 which meets with the pneumatic conveying line 8 at a diverter valve 41 positioned in conveying line 8. Diverter valves are known to those skilled in the art and can be adjusted between a position which permits material to be supplied to the vessel through conduit 8 and inlet 17 and a position which permits material to be withdrawn from the vessel through inlet 17 and the branch line 40 which serves as the outlet for the vessel. A cut off gate 43 may also be used at the inlet/outlet 17.

The bottom 18 of the bin includes a foraminous or gas permeable surface 50 near the bottom 30 of column 25. The gas permeable section 50 may be surrounded by a manifold 51 which is connected to some source of gas. In FIG. 2 the manifold 51 is connected to such source of gas or ambient air by means of a conduit 52. The conduit 52 may also be connected to a source of gas under pressure such as a blower 55 illustrated in FIG. 1. In the alternate, the gas permeable surface 50 may be simply exposed to atmosphere.

The foraminous surface 50 may take the form of a gas permeable fabric, a metal plate with a plurality of holes therethrough, or a plurality of circumferentially spaced apart jets or nozzles extending into the bottom of the cone 16 and flow connected to an annular manifold surrounding the bottom 18 of the vessel. The important concept is that additional gas under pressure is to be supplied to the bottom of the vessel adjacent the bottom of the column 25.

The vent 19 is connected through a conduit 60 to the dust collection system 3. The dust collection system may include a suitable high efficiency dust collector indicated at 61. In the preferred embodiment, the dust collector has the fan on the down stream side of the collector as indicated at 62 connected to the collector 61 by means of a duct 63 and vents to atmosphere. The fan 62 serves to draw a vacuum through the collector 61, duct 60 and blending vessel 2.

In operation, the method of conveying and blending solid particulate material is carried out by establishing a flow of gaseous fluid from a source such as blower 9 through conveying line 8 to inlet 17 of vessel 15. Fresh solid particulate material to be blended is introduced into the flow of gaseous fluid from the source 5 through the valve 7 into the pneumatic conveying line 8 whereby the material is entrained in the gaseous fluid and conveyed through diverter valve 41, past open cut off gate 43 to inlet 17. The energy in the gas under pressure used to convey the fresh material to be blended serves to convey the fresh solid particulate material up through the column 25. As the material is conveyed up through the column it is discharged out of the column in a geyser-like manner to be dispersed outwardly into the bin 15 where it falls down into the vessel. As material is continuously conveyed into the bin 15, additional gas under pressure is independently supplied to the bottom 18 of the vessel adjacent column 25 through foraminous surface 50 for fluidizing material adjacent the bottom of the column and assisting material already in the bin to be drawn past the bottom 30 of column 25 into the inlet or bottom 30 of the column 25 to be conveyed upwardly through the column where it is intimately mixed with the incoming material to be dispersed outwardly into the bin onto the top surface of material already in the bin and thereby blend the material. See the arrows in FIG. 2 designating material flow. The deflector means 35 serves to assist in dispersal of the material throughout the cross sectional area of the bin.

By the present invention, the booster gas supplied through the foraminous or gas permeable surface 50 serves to assist the flow of material up through the column 25 and assist in the drawing or conveying of material already in the vessel into the lower end 30 of column 25. In one embodiment this booster gas can be supplied by a blower such as 55 in FIG. 1. In another embodiment, the booster gas can also be supplied by means of the manifold 51 being connected to atmosphere and the fan 62 drawing a vacuum through the blending vessel 2 to draw ambient air into connection 52, manifold 51, through gas permeable surface 50 into the vessel 15. Most of the vacuum will be drawn within the column 25 to aid in material flowing up through the column 25 to assist in blending material. It should be noted that while in most applications it may not be desirable to rely on a vacuum to draw boost gas through foraminous surface 50 due to high pressure drop, the vacuum drawn on the vessel will still serve to aid in blending.

The flow of gas through the blending vessel 2 by means of the dust collection system 3 and/or positive gas flow from blower 55 serves two functions in addition to that of aiding material flow both broadly considered to be cleaning functions. First, the flow of gas continuously up through the blending vessel 2 serves to remove toxic or other undesirable gas which may be trapped within the bin 15. These gases tend to develop in a system used for blending and storing plastic pellets. Where toxic fumes are present, it may be desirable to use a wet scrubber in lieu of the dust collector 61.

A second cleaning advantage of booster gas is the continuous flow of gas through the blending vessel 2 serves to remove undesirable fine material which may be contained within the plastic pellets or other material being blended by entraining such fines out through the vent 19 into the dust collector 61. The velocity of the gas must be such that the undesired fines are entrained out of the system, but the larger desired material is retained in the vessel 15 to thereby serve to clean the material being blended.

A third function of the boost gas is to aid in withdrawal of material from the bin. During withdrawal, material may tend to bridge the gap between the bottom of the vessel at 18 and the bottom of the column at 30 or cling to the sides of the vessel. The boost gas will aerate or fluidize the material in the bottom section to aid in the uniform movement of material out of the vessel.

With the prior art as illustrated by U.S. Pat. No. 3,276,753, it was known to utilize a vacuum applied to the blending, conveying system to introduce material into the blending bin. With the present invention, the vacuum or booster gas is used primarily for assisting the blending or gas removal or particle cleaning. The booster gas is primarily drawn upwardly through the column 25 so that cleaning and gas removal will take place as the bin 15 is filled and material is being blended.

It has been found that the conveying of the material into the bottom of the blender with the present invention serves to adequately blend the material without the use of additional columns as shown in the prior art. The vessel can then be used to store the blended material until it is time to utilize the same.

While in most applications it is believed that adequate material blending will occur with a single feeding of material to the blender, in some applications it may be necessary to utilize recirculation in order to achieve the desired mixing. With the present invention, this further blending is accomplished by an internal recirculation. The introduction of fresh material into the conveying line 8 is stopped by closing valve 7 while maintaining the flow of gaseous fluid from a source such as blower 9 to the inlet 17 of vessel 15. This serves to continuously recirculate material in the bin up through column 25 for dispersal in a geyser-line or percolator manner onto the top surface of material in the bin. It may or may not be necessary to continuously supply boost gas through surface 50 during recirculation, depending on the specific material being blended.

Figure 3:
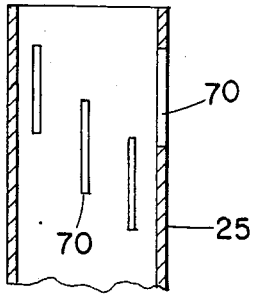
FIG. 3 is a sectional view on an enlarged scale of a portion of a blending column used in one embodiment of the present invention.

For purposes of withdrawal, the valve 43 is opened and diverter valve 41 is adjusted to open outlet conduit 40 at the same time closing inlet conduit 8 to draw material to a use point. Because in some applications the material may tend to layer within the blender, particularly once withdrawal begins because of the material sticking to the sides of the vessel, and in order to insure that the last material which is conveyed to the bin 15 is blended with other material therein, for some applications, it may be necessary to add a plurality of slots 70 to column 25 as illustrated in FIG. 3. The slots 70 are circumferentially spaced around the circumference of column 25 and also longitudinally spaced from each other along the length of the column. In most applications, these slots may not be used, but when used, it is believed that it will only be necessary to provide the slots 70 near the top 31 of column 25, but in some instances it may be advisable to include such slots along the entire length thereof. These slots are generally shown in U.S. Pat. No. 3,647,188.

Figure 5:
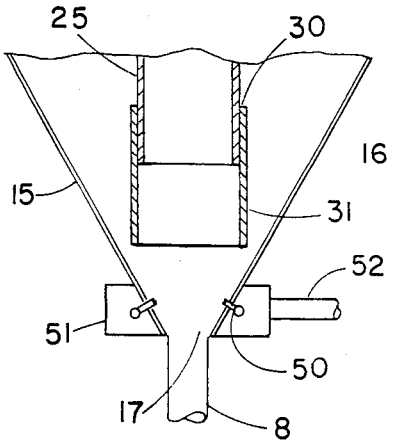
FIG. 5 is a fragmentary view of a portion of a blender according to a further embodiment of the present invention.

In some applications it may be desirable to provide a means for adjusting the distance between the bottom 30 of column 25 and the conical section 16 of the vessel 15. For such applications, we have illustrated in FIG. 5 a telescoping section 80 which may be mounted on the bottom 31 of column 30 to provide a means for adjusting the distance between the column and the bin bottom. This adjustment will help control the volume of material already in the bin which is recirculated through the column 25.

From the foregoing, it should be apparent that the objects of the present invention have been carried out. A very simple blending system has been provided. In fact, the blender can be made out of an existing storage silo by the mere addition of the bottom feed point for the silo and the addition of the central open-ended column 25. The booster gas can be the exhaust gas from some other source, it could be plant air, or it can be the vacuum created by the vent system of the existing bin. Because of the bottom feed to the silo, expensive piping and associated air requirements for conveying material to a top inlet for the vessel is not required. All of the valves, such as valves 41 and 43 are located at the bottom of the system for easy maintenance accessability. The system is further simplified when compared with prior art devices because all of the equipment required for external recirculation of material has been eliminated.

The present invention provides an efficient blender because incoming fresh material is continuously intermingled with material already in the blender. There is continuous blending from the beginning of the fill cycle until the end of the fill cycle which reduces on production time when compared with prior art blenders. The constant purging of the vessel by the booster gas serves to drive off unwanted gas and remove fines which is not accomplished in a single operation by apparatus of the prior art.

Due to the lower velocity of material within the bin 15, it is believed that there will be a reduction in the degradation of the product and thereby reduce the production of fines. With prior blenders which required continuous recirculation, there was a tendency to produce such undesirable fines.

While the system has been shown in FIG. 1 with the vent 19 directly connected to a dust collection system, it will be understood by those skilled in the art that in some cases, a large vent could be used which is not directly connected to a dust collector. FIG. 1 also illustrates a discharge of collected dust from the system. In some cases it may be desirable to return the dust to the bin for further blending.

It is intended that the foregoing description be merely that of preferred embodiments and that the invention be limited solely by that which is within the scope of the appended claims.

We claim:

1. A pneumatic conveying and material blending system comprising a bin having a bottom and a top, an inlet for solid particulate material in the bottom of the bin; a hollow, open-ended vertical column mounted in said bin, spaced from the bottom of said bin and spaced from and coaxially aligned with the inlet for material; means for supplying a stream of gaseous fluid and entrained fresh solid particulate material to be blended to said inlet and upwardly through said column; the bottom of said bin having a foraminous surface adjacent said column; means including said foraminous surface for supplying booster gas to the bottom of said bin to be directed upwardly into said column; said means for supplying a stream of gaseous fluid and entrained fresh material and said means for supplying booster gas defining means for conveying solid particulate material already in the bin upwardly through the column whereby said fresh solid particulate material and said solid particulate material already in the bin are dispersed onto the top surface of material in the bin to thereby blend the material; a manifold externally mounted on said bin surrounding said foraminous surface; and a source of gas under pressure flow connected to said manifold for supplying gas under pressure to said bin for passage upwardly through said bin for entraining solid particulate material already in the bin and removing through said vent fine material which may be contained in the solid particulate material to thereby define a means for cleaning the solid particulate material.

2. A pneumatic conveying and blending system according to claim 1 further comprising means for adjusting the length of the column to thereby adjust the distance between the bottom of said column and the bottom of said bin.

3. A pneumatic conveying and blending system according to claim 1 further comprising an outlet for blended solid particulate material, said outlet being integral with the inlet for material.

4. A method of conveying and blending solid particulate material comprising the steps of:

providing a vessel having an inlet in the bottom thereof and a hollow, open-ended vertical column mounted therein aligned with the inlet and spaced from the bottom of the vessel;

establishing a flow of gaseous fluid through a conveying line to said inlet of the vessel;

introducing solid particulate material to be blended into the flow of gaseous fluid whereby the material is entrained in the gaseous fluid and conveyed by the gaseous fluid to the inlet of the vessel, up through the column and discharged from the top of the column in a geyser-like manner into the vessel;

independently supplying additional gas under pressure to the bottom of said vessel adjacent the column for assisting material already in the vessel to be drawn into and conveyed up the column where it is intimately mixed with material being conveyed to the vessel to thereby blend the material; and further blending the material by stopping the introduction of material into the flow of gaseous fluid through the conveying line whereby material in the bin is recirculated through the column by means of the flow of gaseous fluid and additional gas.

5. A method of conveying and blending solid particulate material according to claim 4 wherein a diverter valve is mounted in the conveying line adjacent the inlet of the vessel and includes a branch line which serves as an outlet for the vessel, which diverter valve can be adjusted between a position which permits material to be conveyed into the vessel and a position which permits material to be withdrawn from the vessel through the outlet, the method further comprising the step of withdrawing blended material from the vessel by adjusting the diverter valve to permit material to flow through the outlet and stopping the flow of gaseous fluid through the conveying line into the vessel while maintaining the independent supply of additional gas to the bottom of the vessel.

* * * * *